US008646734B2

(12) United States Patent
Vered Shaol et al.

(10) Patent No.: US 8,646,734 B2
(45) Date of Patent: Feb. 11, 2014

(54) SPRINKLER IRRIGATION STAND

(75) Inventors: Nitzan Vered Shaol, Kibbutz Magal (IL); Erez Govrin, Kibbutz Magal (IL); Yair Shomer, Pardes Hanna (IL)

(73) Assignee: Netafim, Ltd., Tel Aviv (IL)

( * ) Notice: Subject to any disclaimer, the term of this patent is extended or adjusted under 35 U.S.C. 154(b) by 150 days.

(21) Appl. No.: 13/393,482

(22) PCT Filed: Sep. 12, 2010

(86) PCT No.: PCT/IL2010/000746

§ 371 (c)(1),
(2), (4) Date: Feb. 29, 2012

(87) PCT Pub. No.: WO2011/033501

PCT Pub. Date: Mar. 24, 2011

(65) Prior Publication Data

US 2012/0153096 A1 Jun. 21, 2012

Related U.S. Application Data

(60) Provisional application No. 61/243,158, filed on Sep. 17, 2009.

(51) Int. Cl.
*A47G 29/00* (2006.01)

(52) U.S. Cl.
USPC ..... 248/80; 248/75; 248/87; 239/272; 239/276; 239/280

(58) Field of Classification Search
USPC ..... 248/545, 550, 75, 76, 80, 85, 87, 156; 239/273, 276, 280, 271, 272, 275
See application file for complete search history.

(56) References Cited

U.S. PATENT DOCUMENTS

| | | | | | |
|---|---|---|---|---|---|
| 2,045,336 | A | * | 6/1936 | Skoglund | 248/80 |
| 2,464,958 | A | * | 3/1949 | Allen | 248/75 |
| 2,584,543 | A | * | 2/1952 | Brown | 248/80 |
| 2,939,666 | A | * | 6/1960 | Ohre | 248/76 |
| 3,751,075 | A | * | 8/1973 | Rosenberg | 285/61 |
| 3,843,059 | A | | 10/1974 | Segev | |
| 4,275,839 | A | | 6/1981 | Olson | |
| 5,452,872 | A | * | 9/1995 | Barnes et al. | 248/85 |
| 5,687,910 | A | * | 11/1997 | King | 239/276 |
| 7,097,117 | B2 | * | 8/2006 | Zur et al. | 239/276 |

FOREIGN PATENT DOCUMENTS

WO 2010/013243 2/2010

OTHER PUBLICATIONS

International Search Report in PCT/IL2010/000746, dated Jan. 21, 2011.
Written Opinion in PCT/IL2010/000746, dated Jan. 21, 2011.

* cited by examiner

*Primary Examiner* — Bradley Duckworth
(74) *Attorney, Agent, or Firm* — Womble Carlyle

(57) ABSTRACT

A sprinkler irrigation stand for use with an irrigation pipe has a base placed below the pipe for being stabilized by the pipe. The pipe freely rests upon the base so that it may be lifted freely off the base or may inflate freely upwards in the case the pipe is a collapsible pipe. A riser of the stand for supporting a sprinkler may be attached to the pipe and slide up in relation to the stand when attached to a collapsible pipe that is inflated.

20 Claims, 3 Drawing Sheets

SPRINKLER IRRIGATION STAND

RELATED APPLICATIONS

This is a 35 USC 371 U.S. National Phase of International Application No. PCT/IL/2010/000746 filed 12 Sep. 2010 and published in English as WO 2011/033501A1 on 24 Mar. 2011, which claims priority to U.S. Ser. No. 61/243,158, filed 17 Sep. 2009. The contents of the aforementioned applications are incorporated by reference in their entirety.

TECHNICAL FIELD

Embodiments of the present invention relate to a sprinkler irrigation stand and to the use of such a stand with an irrigation pipe.

BACKGROUND

U.S. Pat. No. 3,843,059 describes a device for attaching risers to an irrigation pipe. The device has complimentary clamp parts that are adapted to tightly clamp therebetween an irrigation pipe, and a riser that is attached to one of the clamp parts is adapted to support a sprinkler.

U.S. Pat. No. 2,939,966 describes a stabilizer for portable irrigation equipment. The irrigation equipment includes a plurality of extension pipes interconnected by couplings and extending up from each coupling is a riser at the top of which is a sprinkler. A stabilizer placed on the ground adjacent the riser is adapted to lean against the riser to hold the riser and sprinkler head in their correct positions.

U.S. Pat. No. 4,275,839 describes stabilizer devices that are fixed to a hose at intervals. Each stabilizer has a base that is positioned on the ground and is provided with a recess for saddling the hose and a clamp member that is attached to a riser and is adapted to clamp the hose from above.

SUMMARY

The following embodiment and aspects thereof are described and illustrated in conjunction with systems, tools and methods which are meant to be exemplary and illustrative, not limiting in scope.

In an embodiment there is provided a sprinkler irrigation stand for use with an irrigation pipe comprising: a base adapted to be placed below a section of the pipe, and a support operatively coupled to the base for supporting a sprinkler at a position above the base, the section of the pipe being adapted to bear downwards against the base to stabilize the base in an upright position in which the sprinkler is located above the base, wherein the section of the pipe freely rests upon the base such that it may urged up away from the base with no obstruction.

Typically, the section of the pipe is unattached to the base from above.

If desired, the pipe is a collapsible pipe and the stand comprises a riser being slidably engaged in the stand, the riser being attached at a lower end to the section of the pipe and at an upper end at the support to the sprinkler, wherein inflation of the section of the collapsible pipe upwards urges the riser to slide upwards.

Preferably, deflation of the section of the collapsible pipe downwards urges the riser to slide downwards.

Optionally, the stand comprises a rod being fixed to the base and the rod is attached at an upper end at the support to the sprinkler.

Optionally, an arm extends up from the base and the riser is slidably engaged in the arm.

If desired, the arm comprises a through going bore and the riser extends through the bore in the sliding engagement.

In another embodiment there is provided a method for operatively coupling a sprinkler irrigation stand to an irrigation pipe comprising the steps of: providing an irrigation stand comprising a base, locating the stand with its base placed upon a ground face, placing a section of the pipe so that it freely rests upon the base, and providing a sprinkler that is supported by the stand at a position above the base and in fluid communication with the section of the pipe, wherein the coupling of the stand and the section of the pipe is such that the pipe may be freely lifted up from the base at any time.

If desired, the pipe is a collapsible pipe and the stand comprises a riser being slidably engaged in the stand, the riser being attached at a lower end to the section of the pipe and at an upper end to the sprinkler, wherein inflation of the section of the collapsible pipe upwards urges the riser to slide upwards.

Typically, the section of the pipe when freely resting upon the base is unattached to the base.

In addition to the exemplary aspects and embodiment described above, further aspects and embodiments will become apparent by reference to the figures and by study of the following detailed descriptions.

BRIEF DESCRIPTION OF THE FIGURES

Exemplary embodiments are illustrated in referenced figures. It is intended that the embodiments and figures disclosed herein are to be considered illustrative, rather than restrictive. The invention, however, both as to organization and method of operation, together with objects, features, and advantages thereof, may best be understood by reference to the following detailed description when read with the accompanying figures, in which.

Figure 1:
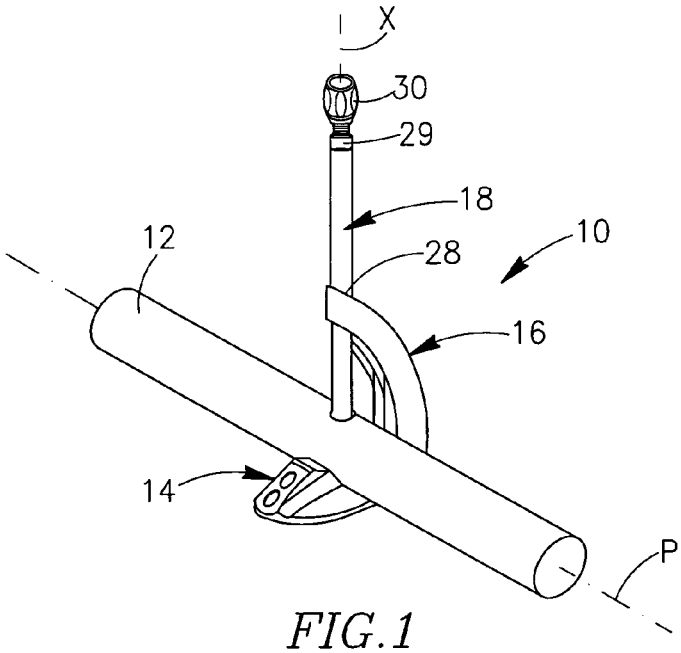
FIG. 1 shows a perspective top view of a sprinkler irrigation stand in accordance with a first embodiment of the present invention and an irrigation pipe.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated within the figures to indicate like elements.

DETAILED DESCRIPTION

Figure 5:
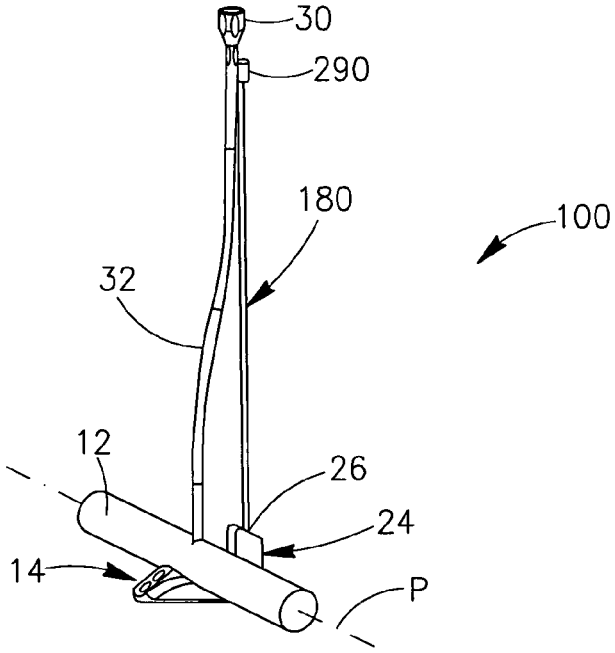
FIG. 5 shows a perspective top view of a sprinkler irrigation stand in accordance with a second embodiment of the present invention and an irrigation pipe.

Attention is first drawn to FIGS. 1 and 5 showing respectively a first and a second embodiment of a sprinkler irrigation stand 10, 100 in accordance the present invention that is adapted to be operatively coupled to an irrigation pipe 12 for performing a sprinkling irrigation process. The pipe 12 extends along an axis P in a field and in accordance with various embodiments of the present invention may be any type of pipe such as a rigid or flexible pipe.

Figure 2A:
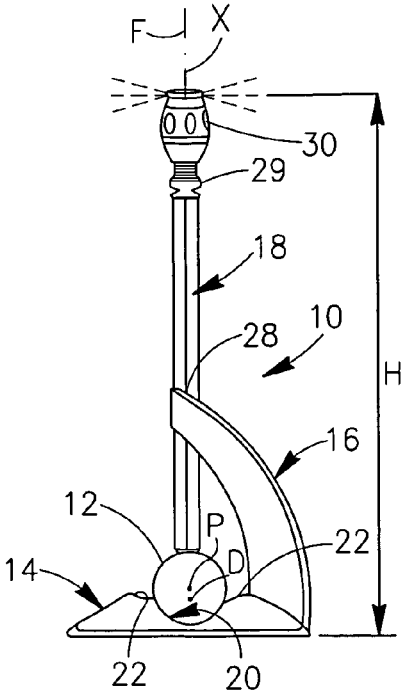
FIGS. 2A and 2B show the sprinkler irrigation stand of FIG. 1 coupled to an optional collapsible irrigation pipe that is shown respectively inflated and deflated.
Figure 6A:
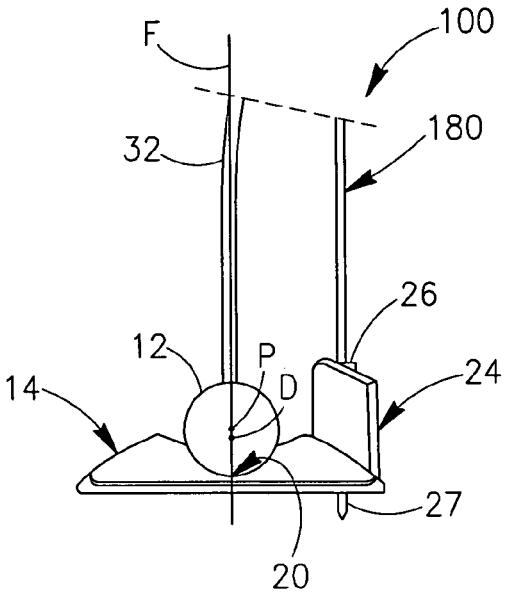
FIGS. 6A and 6B show the sprinkler irrigation stand of FIG. 5 coupled to an optional collapsible irrigation pipe that is shown respectively inflated and deflated.

Attention is now drawn to FIGS. 2A, 2B, 6A and 6B. In some embodiments of the present invention, the stand 10, 100 may be operatively coupled to a collapsible irrigation pipe 12 that has a relatively thin walled flexible construction. Such a collapsible pipe 12 may be deflated to be relatively light-weight at any time that substantially no liquid is flowing therethrough (FIGS. 2B, 6B) and may swell up to an inflated weighted profile substantially full of liquid flowing there-through (FIGS. 2A, 6A).

Attention is drawn to FIGS. 1 to 4. The sprinkler stand 10 in accordance with the first embodiment has a base 14, an arm 16 and a riser 18. The base 14 has a depression 20 that opens upwardly and has a face 21 that lies on a portion of an imaginary cylindrical surface having an axis D. Two tapering lands 22 of the base 14 located on opposite sides of the depression 20 converge downwards towards the depression 20. A bulge 24 (seen in FIG. 4) of the base 14 extends up from the base 14 adjacent one of the lands 22 at a side of said land 22 that is distal of the depression 20. The bulge 24 has a coupling 26 optionally in the form of a through going lumen that opens out of the base 14 at the upper side of the bulge 24 and at the lower side of the base 14.

In the first embodiment of the assembled stand 10, the arm 16 is adapted to be mounted on the bulge 24 and extend up from there to an upper end of the arm 16 that overlies the depression 20 of the base 14 from above. An optional through going bore 28 is formed in the upper end of the arm 16 about an axis X that extends down to the depression 20. The riser 18 in the first embodiment of the stand 10 is hollow and is adapted to be in sliding engagement with the bore 28 along axis X by extending axially therethrough. A lower end of the riser 18 is attached to the pipe 12 to allow communication with liquid that may flow in the pipe 12. An upper end 29 of the riser 18 supports a sprinkler 30 and the riser 18 allows communication of liquid from the pipe 12 thereto.

It should be noted that directional terms appearing throughout the specification and claims, e.g. "forward", "rear", "up", "down" etc., (and derivatives thereof) are for illustrative purposes only, and are not intended to limit the scope of the appended claims. The directional terms "up" and "down" are also noted as referring to directions generally along the axis X and in addition it is noted that the directional terms "down", "below" and "lower" (and derivatives thereof) define identical directions.

Figure 6B:
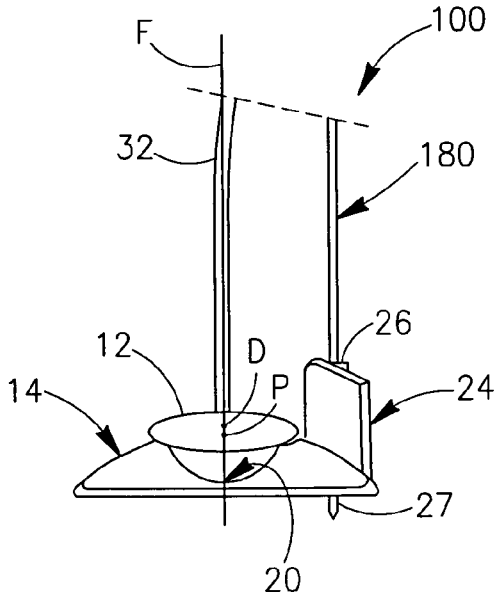

Attention is now drawn to FIGS. 5, 6A and 6B. The stand 100 in accordance with the second embodiment of the present invention constitutes the base 14 as in the first embodiment of the stand 10 and a rod 180 fixed to the coupling 26 of the bulge 24. Optionally, the rod 180 extends all the way through the lumen of coupling 26 to a lower end 27 that projects into the soil below the base 14 of the stand 100. A sprinkler 30 is supported at an upper end 290 of the rod 180 and a flexible lumen 32 extends down from the sprinkler 30 to communicate with liquid flowing in the pipe 12.

Attention is drawn to FIGS. 1, 2A, 2B and 5, 6A, 6B. The stand 10, 100 is operatively mounted to the pipe 12 by laying the pipe 12 from above onto the base 14 so that the pipe 12 freely overlies the base 14 at the depression 20 with the axis P of the pipe 12 being generally parallel to the axis D of the depression 20. An imaginary plane F is defined as including axis P and being generally perpendicular to the face of the ground upon which the stand 10, 100 is placed.

The pipe 12 is preferably not attached in any way to the base 14 from above so that it may be easily removed from the base 14 by simply lifting the pipe 12 off the base 14. Such a need to easily remove of the pipe 12 from the base 14 may occur for example when re-positioning the irrigation stand 10, 100 and/or pipe 12 in the field to for example irrigate a new area in the field or when for example temporary shifting the irrigation stand 10, 100 and/or pipe 12 in the field to make way for agricultural machinery to enter the field.

Attention is specifically drawn to FIGS. 2A, 2B, 6A and 6B. The stand 10, 100 in accordance with the embodiments of the present invention when used with a collapsible pipe 12 allows free inflation of the pipe 12 upwards to assume an optional weighted circular cross section when liquid is flowing therethrough (FIGS. 2A and 6A). Deflation of the collapsible pipe 12 may be characterized by the pipe's contraction along axis X and expansion sideways away from plane F to assume a generally elliptical or flatted cross section (FIGS. 2B and 6B) when liquid is substantially not flowing there-through. The collapsible pipe 12 in the case where it expands sideways in its deflated state may in some embodiments rest at its lower lateral sides on the lands 22 that are located on both sides of the depression 20.

The load of the pipe 12 when full of liquid flowing there-through, which in the optional case of a collapsible pipe 12 is characterized by its inflated and weighted profile, is adapted to bear downwards upon the base 14 and thereby stabilize the base 14 of the stand 10, 100 upon which it rests. As a result, the stand 10, 100 is stabilized by the weighted pipe 12 so that it better maintains its upright position in which the riser 18 or rod 180 extend generally perpendicularly upright in relation to the face of the ground upon which the stand 10, 100 is positioned.

Figure 2B:
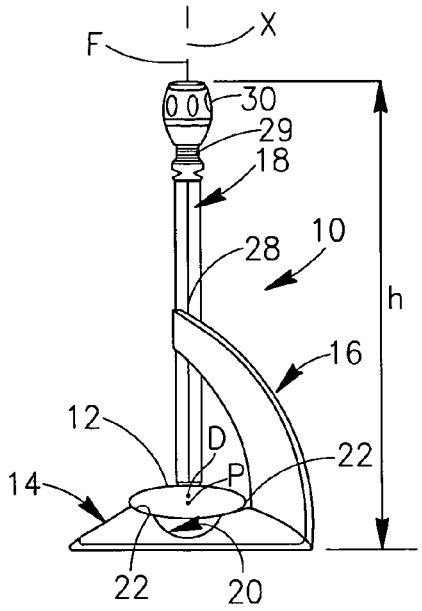
Figure 3:
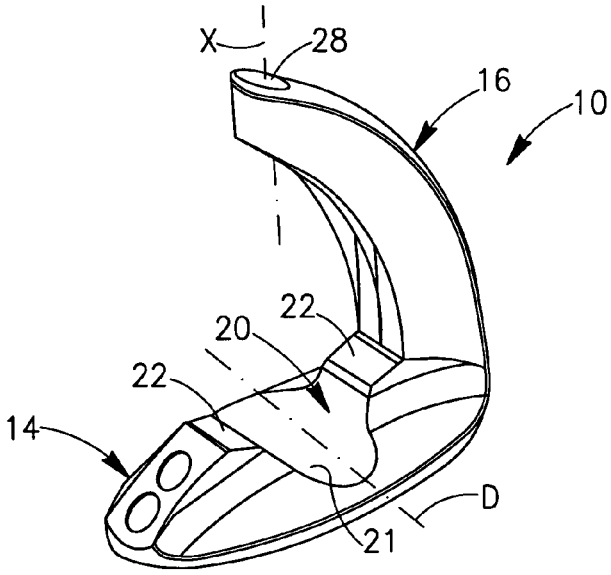
FIG. 3 shows a base and an arm of the irrigation stand of FIG. 1.
Figure 4:
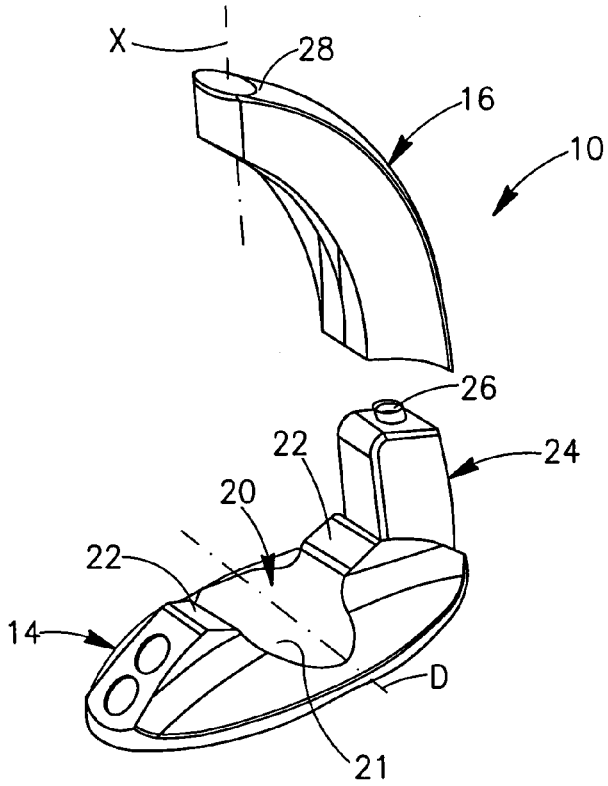
FIG. 4 shows an exploded view of the base and arm shown in FIG. 3.

Attention is drawn specifically to FIGS. 2A and 2B. As described hereinabove, the stand 10 in accordance with the first embodiment of the present invention when optionally attached to a collapsible pipe 12 allows the pipe 12 to assume its inflated and deflated states. As the pipe 12 inflates (FIG. 2A), the riser 18 slides upwardly through the bore 28 and the sprinkler 30 that is attached to the upper end 29 of the riser 18 assumes a height H above the ground face upon which the stand 10 is located. Notably, the liquid pressure in the inflated pipe 12 may be sufficient to urge the sprinkler 30 when positioned at height H to perform a sprinkling operation.

As the collapsible pipe 12 deflates (FIG. 2B), the riser 18 slides back down through the bore 28 and the sprinkler 30 that is attached to the upper end 29 of the riser 18 assumes a height h above the ground face upon which the stand 10 is located. As seen in these figures, height H of the sprinkler 30 in the inflated state of the pipe 12 is larger than height h of the sprinkler 30 in the deflated state of the pipe 12.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

Although the present embodiment has been described to a certain degree of particularity, it should be understood that various alterations and modifications could be made without departing from the scope of the invention as hereinafter claimed.

The invention claimed is:

1. A sprinkler irrigation stand for use with an irrigation pipe comprising:

a base adapted to be placed below a section of the pipe, and a sprinkler supported by the stand at a position above the base, the section of the pipe being adapted to bear downwards against the base to stabilize the base in an upright position in which the sprinkler is located above the base, wherein the section of the pipe freely rests upon the base such that it may be urged up away from the base with no obstruction.

2. The sprinkler irrigation stand according to claim 1, wherein the section of the pipe is unattached to the base from above.

3. The sprinkler irrigation stand according to claim 1, wherein the pipe is a collapsible pipe and the stand comprises a riser being slidably engaged in the stand, the riser being attached at a lower end to the section of the pipe and at an upper end to the sprinkler, wherein inflation of the section of the collapsible pipe upwards urges the riser to slide upwards.

4. The sprinkler irrigation stand according to claim 3, wherein deflation of the section of the collapsible pipe downwards urges the riser to slide downwards.

5. The sprinkler irrigation stand according to claim 1, wherein the stand comprises a rod being fixed to the base and the rod is attached at an upper end to the sprinkler.

6. The sprinkler irrigation stand according to claim 3 comprising an arm extending up from the base and the riser is slidably engaged in the arm.

7. The sprinkler irrigation stand according to claim 6, wherein the arm comprises a through going bore and the riser extends through the bore in the sliding engagement.

8. A method for operatively coupling a sprinkler irrigation stand to an irrigation pipe comprising the steps of:

providing an irrigation stand comprising a base, locating the stand with its base placed upon a ground face, placing a section of the pipe so that it freely rests upon the base, and providing a sprinkler that is supported by the stand at a position above the base and in fluid communication with the section of the pipe, wherein the coupling of the stand and the section of the pipe is such that the pipe may be freely lifted up from the base.

9. The method according to claim 8, wherein the pipe is a collapsible pipe and the stand comprises a riser being slidably engaged in the stand, the riser being attached at a lower end to the section of the pipe and at an upper end to the sprinkler, wherein inflation of the section of the collapsible pipe upwards urges the riser to slide upwards.

10. The method according to claim 8, wherein the section of the pipe when freely resting upon the base is unattached to the base.

11. The sprinkler irrigation stand according to claim 5, wherein the rod has a lower end which extends below the base and is suitable for projecting into soil below the base to stabilize the base, when the sprinkler irrigation stand is deployed in a field.

12. The sprinkler irrigation stand according to claim 1, wherein:

the base has a depression that opens upwardly; and two tapering lands are located on opposite sides of the depression, the two tapering lands converging towards the depression.

13. The sprinkler irrigation stand according to claim 12, wherein:

when the pipe is a collapsible pipe and in a deflated state, the collapsible pipe at least partially rests on the tapering lands.

14. A sprinkler irrigation stand comprising:

a base having a depression that opens upwardly, the depression suitable for receiving a section of collapsible irrigation pipe;

an arm extending up from the base; and a riser positioned over the depression and slidably engaged to the arm such that the riser can be urged to slide downwards towards and upwards away from the base, in response to respective deflation and inflation of the section of collapsible pipe, the riser having an upper end provided with a sprinkler support.

15. The sprinkler irrigation stand according to claim 14, wherein the arm has a through going bore; and the riser passes through the through going bore and is slidably engaged therein.

16. The sprinkler irrigation stand according to claim 15, further comprising:

two tapering lands located on opposite sides of the depression and converging towards the depression.

17. The sprinkler irrigation stand according to claim 15, further comprising:

a sprinkler connected to the sprinkler support.

18. The sprinkler irrigation stand according to claim 17, wherein, when a section of collapsible irrigation pipe is received into the depression:

a lower end of the riser is attached to the section of collapsible irrigation pipe.

19. The sprinkler irrigation stand according to claim 18, wherein:

the section of collapsible pipe freely rests upon the base such that it may be urged up away from the base with no obstruction.

20. The sprinkler irrigation stand according to claim 15, further comprising a lower end which extends below the base and is suitable for projecting into soil below the base to stabilize the base, when the sprinkler irrigation stand is deployed in a field.

* * * * *